United States Patent [19]

Linn

[11] 4,305,319

[45] Dec. 15, 1981

[54] MODULAR DRUM GENERATOR

[76] Inventor: Roger C. Linn, 3249 Tareco Dr., Hollywood, Calif. 90068

[21] Appl. No.: 80,338

[22] Filed: Oct. 1, 1979

[51] Int. Cl.[3] ..... G10H 1/00

[52] U.S. Cl. ..... 84/1.01; 84/1.27; 84/DIG. 12

[58] Field of Search ..... 84/1.03, DIG. 12, 1.01, 84/1.27

[56] References Cited

U.S. PATENT DOCUMENTS

| | | | |
|---|---|---|---|
| 3,763,364 | 10/1973 | Deutsch et al. | 84/1.03 |
| 3,840,691 | 10/1974 | Okamoto | 84/DIG. 12 |
| 4,095,501 | 6/1978 | Aoki | 84/1.03 |

OTHER PUBLICATIONS

Lancaster, TTL Cookbook, 1974, p. 75.

*Primary Examiner*—R. L. Moses
*Assistant Examiner*—Forester W. Isen
*Attorney, Agent, or Firm*—W. Edward Johansen

[57] ABSTRACT

The present invention is an improved modular drum generator which plays a recorded drum beat and which may be used in combination with a plurality of identical, improved modular drum generators to provide an electronic percussion section. The improved modular drum generator includes a bistable latch which has a clock input, which is electrically coupled to a computer which generates a "play" strobe pulse, a set of three data inputs, one of which is held at logic "1" and the other two of which are electrically coupled to a computer data bus which also generates volume data and pitch data, a reset input and a set of three outputs corresponding to the data inputs. The improved modular drum generator further includes a voltage controlled oscillator the input of which is electrically coupled to the pitch output of the bistable latch and the output of which is electrically coupled to the clock input of a twelve bit binary counter, which provides $2^{12}$ data words, thereby controlling the frequency of data conversion thereof. The enable count input of the twelve bit counter is electrically coupled to the "play" output of the bistable latch and the end of count output is electrically coupled to the reset input of the bistable latch. The improved modular drum generator further includes a read only memory, which contains $2^{12}$ binary words representing same on an analog waveform, which is a recording of the sound of a single drum strike, a digital to analog converter, which is electrically coupled to the read only memory in order to receive the binary words and to reconvert it to analog data so that it can be played through an amplifier, and an amplifier, which is electrically coupled to the analog to digital converter.

2 Claims, 3 Drawing Figures

MODULAR DRUM GENERATOR

BACKGROUND OF THE INVENTION

1. Field of the Invention

The present invention relates to electronic musical instruments and more particularly to a modular electronic circuit which is capable of duplicating the sound that results from striking a natural percussion instrument or any other short duration sound such a bat impacting a baseball.

2. Description of the Prior Art

U.S. Pat. No. 4,148,240, entitled Percussion Simulating Techniques, issued to Douglas R. Moore and Alberto Kniepkamp on Apr. 10, 1979, teaches an improved electronic musical instrument capable of simulating a sound resulting from the striking of a natural percussion instrument. The electronic instrument includes playable keys, a tone signal generator for generating tone signals and an output circuit for converting the tone signals to audible tones. A control circuit responsive to the depression of any one of the keys enables one or more of the tone signals representing one or more fundamental pitches to be transmitted to the output circuit for a first time period and enables another tone signal representing a pitch nonharmonically related to the fundamental pitches to be transmitted to the output for a second time period less than the first time period. By combining the tone signals corresponding to the fundamental and nonharmonic pitches the sound of a percussion instrument is simulated.

The general nature of the harmonic spectrum of natural percussion instruments, such as a xylophone, bars, bells or chimes, has been known for some time. After a short transient or strike time period resulting from striking a percussion instrument has passed, the instrument generally emits a sustaining tone (which gradually decays) having a fundamental pitch or frequency component, together with harmonic frequency components. However, during the strike time period immediately after the instrument is struck, complex sound waves (i.e., strike tones) having complex frequency spectra are generated. In general, these complex strike tones are nonharmonic; that is, they are non integer multiples of the fundamental frequency produced by the sustaining tone of the instrument.

The electronic musical instrument industry has long sought economical techniques for simulating the sound waves produced by natural percussion instruments, especially the complex transient strike tone produced by the striking of instruments. However, the strike tones are so complex that no economical way of simulating them has been discovered. Complex and costly electronic devices for simulating percussive sounds have been proposed in the past. For example, in a paper entitled, "The Synthesis of Audio Spectra by Means of Frequency Modulation," published in the Journal of the Audio Engineering Society, Volume 27, Number 7, dated Sept. 7, 1973, John Chowning proposes that percussive sounds, such as bells, and chimes can be simulated by frequency modulation circuitry. However, this technique requires complicated frequency modulation equipment, including means for modulating the index of modulation. The frequency modulation equipment is required by Chowning in order to produce the nonharmonic pitches required to simulate the strike tone of a natural percussion instrument.

U.S. Pat. No. 4,135,423, entitled Automatic Rhythm Generator, issued to Glenn M. Gross on Jan. 23, 1979, teaches an automatic rhythm generator of an electrical musical instrument which includes a rhythm pattern generator for rhythmically selecting for actuation different ones of a plurality of instrumentation circuits to be sounded and a strobe pulse generating circuit for establishing the appropriate pulse width of a drive pulse needed by each instrumentation circuit for proper actuation thereof. The rhythm pattern generator circuit selectively enables a plurality of drive gates respectively associated with the plurality of instrumentation circuits during selected ones of a succession of periodic rhythm cycles in accordance with a predetermined rhythm pattern. The strobe circuit is synchronized with the rhythm pattern generator and generates during each rhythm cycle a plurality of strobe pulses on a corresponding plurality of outputs respectively associated with the plurality of instrumentation circuits. Each of the strobe pulses has a width preselected for the instrumentation circuit which it is associated. The enabled drive gates provide a drive pulse to their associated instrumentation circuits in response to, and having a pulse width proportional to that of, the strobe pulse applied thereto.

Automatic rhythm playing or generating systems for use with electronic organs or similar instruments are well known in the art. Examples of such circuits are shown in a large number of U.S. Pat. Nos. including 3,548,065 of Freeman issued Dec. 15, 1970, to Chicago Musical Instrument Co., now Norlin Music, Inc., the assignee of the present application; 3,553,334 of Freeman issued Jan. 5, 1971, to Chicago Musical Instrument Co.; 3,567,838 of Tennes issued Mar. 2, 1971, to Hammond Corporation; 3,760,088 of Nakada issued Sept. 18, 1973, to Nippon Gakki Seizo Kabushika Kaisha; 3,763,305 of Nakada et al., issued Oct. 2, 1973 to Nippon Gakki Seizo Kabushiki, 3,764,722 of Southard issued Oct. 9, 1973, to C. G. Conn Ltd.; and 3,840,691 of Okamoto issued Oct. 8, 1974, to Nippon Gakki Seizo Kabushiki. Reference may be had to these patents for a detailed description of the different types of circuitry and the various techniques by which rhythm signals and tones may be automatically generated.

Briefly, all such circuits employ a plurality of rhythm voice or instrumentation circuits which produce tone signals respectively corresponding to a plurality of different musical instruments and suitable circuitry for actuating preselected ones of the instruments during selected ones of a succession of rhythm cycles. The tempo or rate at which the rhythm cycles are generated is customarily established by an oscillator or rhythm clock which is variable in frequency. In such circuits, different rhythm patterns are selected through means of manually actuateable switches to choose different rhythm patterns such as rhythms for a march, tango, swing, cha-cha, and rock. The different instrumentation circuits simulate different percussion instruments such as blocks, bass drum, brush cymbal, snare drum, etc. or even non-percussion instruments.

Depending upon the rhythm patter selected, none, one or plural instrumentation circuits are actuated during each rhythm cycle. For example, with the rhythm pattern for swing selected, the bass drum and brush instrument circuits may be actuated on the first rhythm cycle, no instruments actuated during the second and third rhythm cycles, the snare drum actauted during the fourth rhythm cycle, no instrument actuated during the fifth rhythm cycle, the brush instrument again actuated on the sixth rhythm cycle and so on in like manner for the next six rhythm cycles.

Each of the instrumentation circuits require a drive pulse applied thereto of appropriate width for proper actuation. Typically, each of the instrumentation circuits comprises a band pass filter having a high Q characteristic that produces an exponentially decaying sine wave on its output having a frequency equal to the resonant frequency of the filter. This sine wave output of each instrumentation circuit is produced when a rectangular wave drive pulse which should be approximately equal to one-fourth the period of the resonant frequency, for a drive pulse of this width when applied to the instrumentation circuit, will result in an output signal of optimum characteristics with regard to amplitude and distortion.

In known automatic rhythm system, drive pulses of suitable width have been provided by means of monostable multivibrators or other suitable pulse shaping circuits. The monostable multivibrators, in turn, are driven by pulses of arbitrary widths without regard to the needs of the instrumentation circuit.

Disadvantageously, such monostable multivibrators and pulse shaping circuits were not readily amenable to embodiment in integrated circuit form together with the other parts of the automatic rhythm generator circuitry. Accordingly, the cost reducing and other benefits derived by providing the entire automatic rhythm generator circuitry in integrated circuit form had not heretofore been obtained until the device of U.S. Pat. No. 4,135,423.

U.S. Pat. No. 4,058,043, entitled Programmable Rhythm Apparatus, issued to Masashi Shibahara on Nov. 15, 1977, teaches a programmable rhythm apparatus for use with an electronic musical instrument which includes a sequential pulse generator, a plurality of individually programmable rhythm channels or tracks each producing an output pulse pattern in response to the sequential pulse generator and a standard voice generation circuit to receive the pulse output pattern from the programmed rhythm channels. The voice generation circuit produces a signal representative of an unpitched instrument with a rhythm pattern corresponding to the pulse output pattern of an individual rhythm channel. The voice generation circuit output signals corresponding to each rhythm channel and representing different unpitched instruments are combined and applied to an audio transducer. Each individual rhythm channel can be programmed by the instrument player to provide a pulse output sequence representative of any rhythm pattern desired. Each rhythm channel has a plurality of logic means and a selection means. The instrument player uses the selection means to set or program various ones of the plurality of logic means to form a pattern corresponding to the desired rhythm. Thereafter, each set logic means produces an output pulse upon receipt of a sequence pulse from the pulse generator. A switching network can be provided between the outputs of the rhythm channels and the input terminals of the voice generation circuit to provide increased flexibility and versatility. Furthermore, the programmable rhythm apparatus can be used in conjunction with the fixed rhythm matrices of the prior art to provide selectable rhythm variation for certain unpitched musical instruments and the standard rhythm for others.

U.S. Pat. No. 4,163,407, entitled Programmable Rhythm Unit, issued to Peter E. Solender on Aug. 7, 1979, teaches a programmable rhythm unit which includes an oscillator which provides a continuous chain of pulses at a predetermined frequency, a circuit which is connected to the oscillator for sequentially and repeatedly arranging the pulses in groups of an equal and predetermined number of pulses corresponding to repeating measures having an equal and predetermined number of beats per measure. The circuit includes a plurality of output lines for receiving the pulses to establish fixed beat positions in each measure, a plurality of rhythm voice input lines, a programmable array for selectively transferring the pulse from selected ones of the output lines to selected ones of the plurality of rhythm voice input lines, and pseudo-randum pulse generator connected to the circuit and to the programmable array for providing a random pulse at a predetermined beat position in each group corresponding to a random beat per measure. The programmable array includes a circuit which selectively transfers the random beat to selected ones of the rhythm voice input lines to establish a programmed rhythm pattern at the rhythm voice input lines. A keyer driver circuit is connected to the rhythm voice input lines, audio signal generator means, and rhythm voicing circuit which is connected to the keyer driver circuit and to the audio signal generator for simulating the audio output of a pluraility of rhythm instruments in accordance with the programmed rhythm pattern.

In all of the above-cited patents the conventional rhythm generator of the prior art which are used in electronic organs produces a sound of a set of percussion instruments which is simulated by one of the following: audio oscillators, envelope generators and tuned resonance circuits. These sounds which are produced by these rhythm generators are close approximations of the actual percussion sounds, but there is much room for improvement.

SUMMARY OF THE PRESENT INVENTION

In view of the foregoing factors and conditions which are characteristic of the prior art, it is the primary object of the present invention to provide a modular drum generator which may be used with a set of identical modular drum generators to electronically produce recorded percussion sounds rather than simulated percussion sound.

It is another object of the present invention to provide a modular drum generator which can be remotely controlled to electronically produce a drum sound at two different pitches thereby allowing one modular drum generator to function as two modular drum generators as in the case of a high conga drum and a low conga drum.

It is still another object of the present invention to provide a modular generator which can be remotely controlled to produce two volumes levels in order to simulate a soft or hard hit of the drum.

In accordance with the preferred embodiment of the present invention, an improved modular drum generator which plays a recorded drum strike and which may be used in combination with a plurality of identical, improved modular drum generators to provide an electronic percussion section is described. The improved modular drum generator includes a bistable latch which has a clock input, which is electrically coupled to a computer which generates a "play" strobe pulse, a set of three data inputs, one of which is tied to a logic "1" and the other two of which are electrically coupled to a computer data bus which also generates volume data and pitch data, a reset input and a set of three outputs. The improved modular drum generator further includes a voltage controlled oscillator the input of which is electrically coupled to one of the outputs of the bistable latch and the output of which is electrically coupled to the clock input of the twelve bit binary counter (for $2^{12}$ binary data words) thereby controlling the frequency of data conversion thereof. The enable count of the twelve bit counter is electrically coupled to one of the outputs of the bistable latch and the end of count output is electrically coupled to the reset input of the bistable latch. The improved modular drum generator further includes a read only memory, which contains $2^{12}$ data word representing sample points along the wave form of a single drum strike sound, a digital to analog converter, which is electrically coupled to the read only memory in order to receive digitized data and to reconvert it to analog data so that it can be played through an amplifier, and an amplifier, which is electrically coupled to the analog to digital converter.

The features of the present invention which are believed to be novel are set forth with particularity in the appended claims.

Other objects and many of the attendant advantages of this invention will be more readily appreciated as the same becomes better understood by reference to the following detailed description and considered in connection with the accompanying drawing in which like reference symbols designate like parts throughout the figures.

DESCRIPTION OF THE PREFERRED EMBODIMENT

Figure 1:
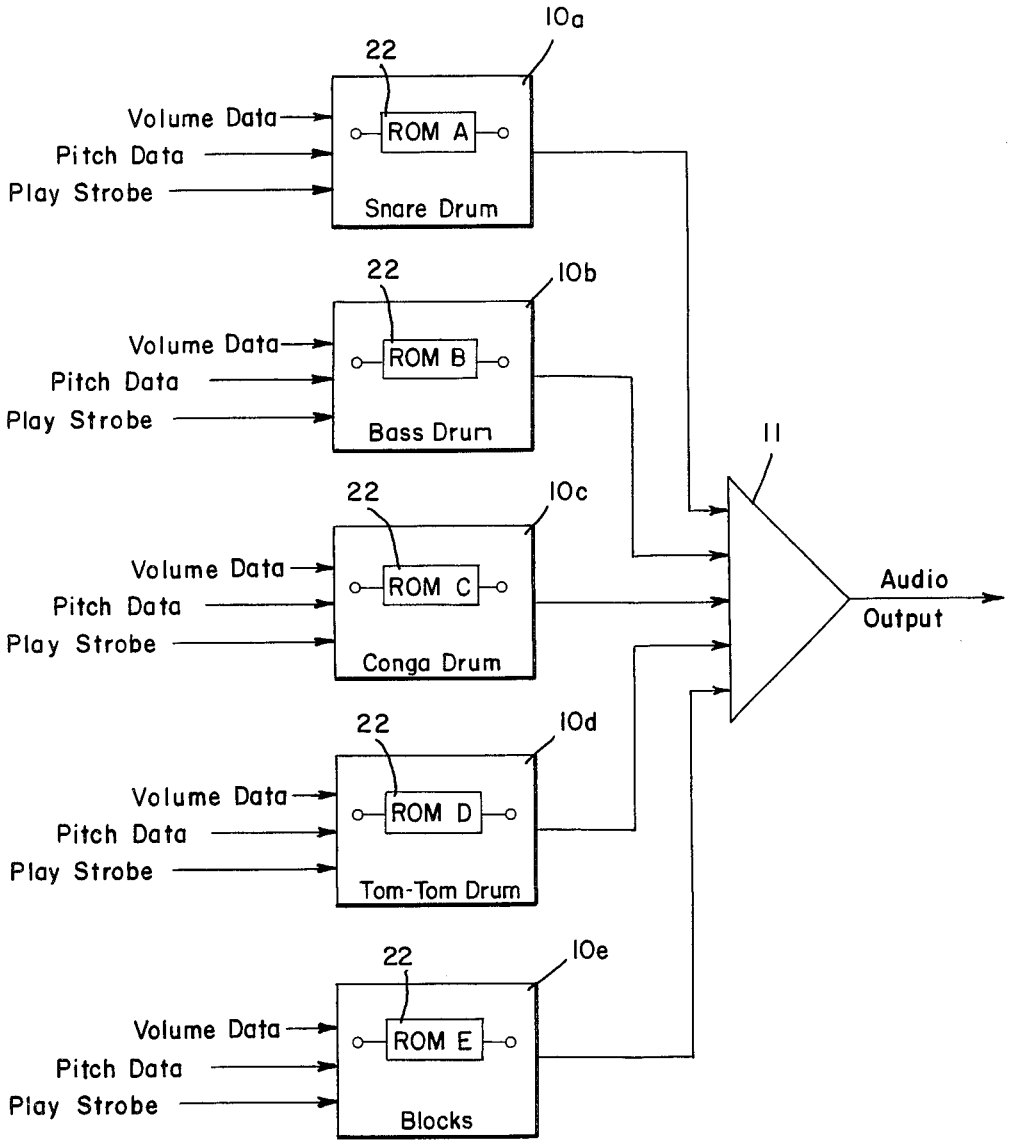
FIG. 1 is a schematic drawing of a plurality of improved modular drum generators which have been constructed in accordance with the principles of the present invention to provide an electronic percussion section.
Figure 2:
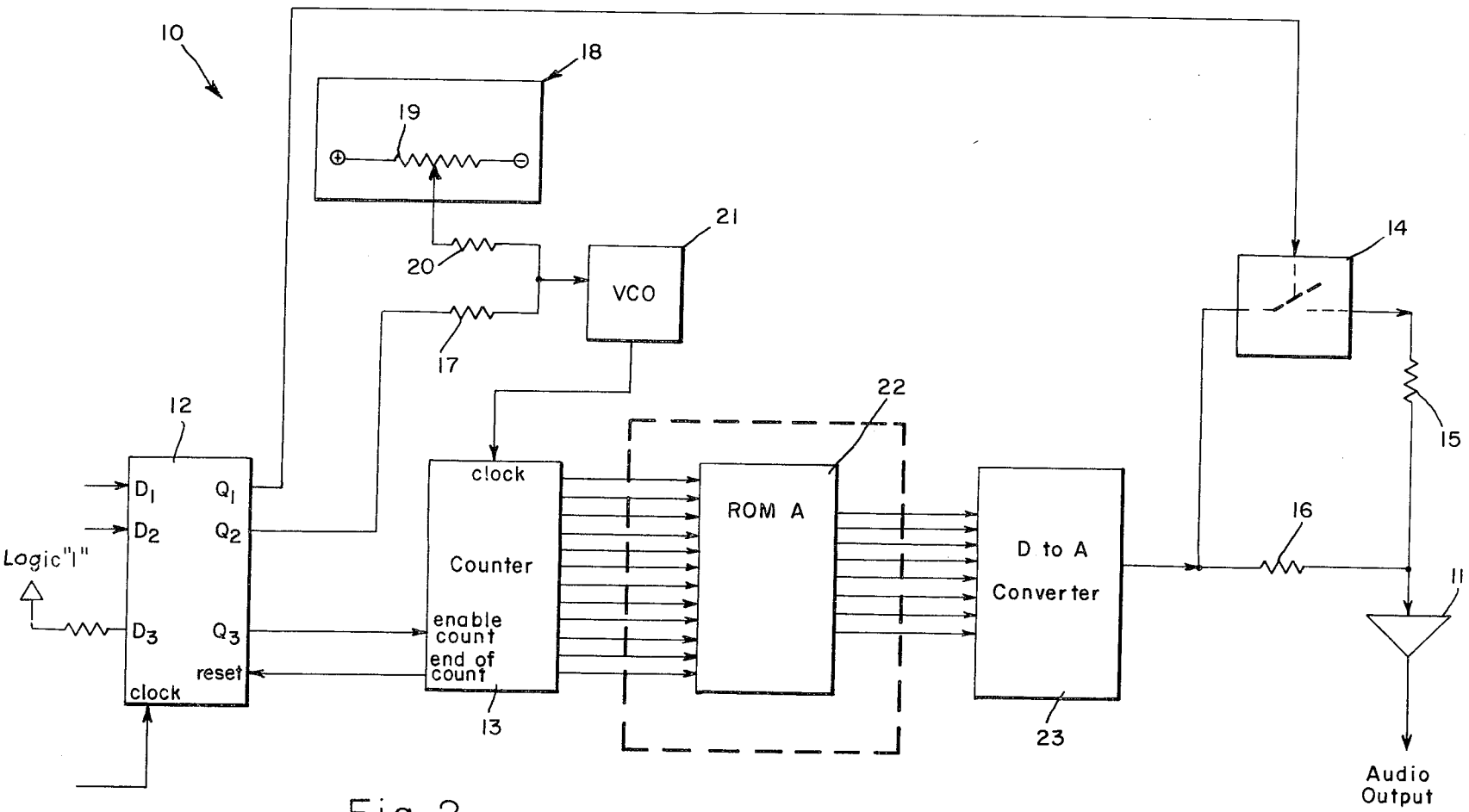
FIG. 2 is a schematic of one of the improved modular drum generators of FIG. 1.

In order to best understand the present invention it is necessary to refer to the following description of its preferred embodiment in conjunction with the accompanying drawing. Referring to FIG. 1 a plurality of improved modular drum generators 10 are electronically coupled to an amplifier 11 which has an input and an audio output. Referring to FIG. 2 each of the improved modular drum generators 10 includes a bistable latch 12 which has a first data input, a second data input, a third data input and a clock input. A computer for controlling the plurality of improved modular drum generators 10 provides a volume data signal to the first data input, a pinch data signal to the second data input and a "play" strobe pulse to the clock of each of the improved modules of drum generators 10, with each third data input, being electrically coupled to a logic "1" through a resistor. In its preferred embodiment the present invention uses two dual bit bistable latches as the bistable latch 12 which have a Texas Instrument part number of 7474.

The improved modular drum generator 10 also includes a twelve bit binary counter 13 which has a clock input, an enable count and an end of count. The bistable latch 12 also has a first data output which is electrically coupled to an analog switch 14, a second data output, a third data output which is electrically coupled to the enable count of the twelve bit binary counter 13 and a reset input which is electrically coupled to the end of count. In its preferred embodiment, the present invention uses as the twelve bit counter 13 a pair of dual four-bit binary counters each of which has a Texas Instrument part number of 74393. It also uses as the analog switch 14, an analog switch which has a National Semiconductor part number of LF13331. The analog switch 14 is electrically coupled to a second resistor 15 which is electrically coupled to the input of the amplifier 11. A third resistor 16 is electrically coupled to both the output of the improved modular drum generators and the input of the amplifier 11.

The second data output of the bistable latch 12 is electrically coupled to a fourth resistor 17. The improved modular drum generator 10 further includes a variable voltage source 18 which includes a variable resistor 19 which is electrically disposed across a voltage potential and a fifth resistor 20, which is electrically coupled between the fourth resistor 17 and the variable resistor 19, and a voltage controlled oscillator 21 having an input, which is electrically coupled to the fourth resistor 17 and the fifth resistor 20, and an oscillating output, which is electrically coupled to the clock input of the twelve bit binary counter 13. In its preferred embodiment the present invention uses as the voltage controlled oscillator 21 a voltage controlled oscillator which has a Texas Instrument part number of SN74124.

The improved modular drum generator 10 further includes a read only memory 22, which contains $2^{12}$ digitized words representing a successive sample points of the wave form of a recorded drum strike, having an input which is electrically coupled to the twelve bit binary counter 13, and an output and a digital to analog converter 23, which has an input which is electrically coupled to the output of the read only memory 22 and an output which is electrically coupled to the input of the analog switch 14 and the third resistor 16.

Figure 3:
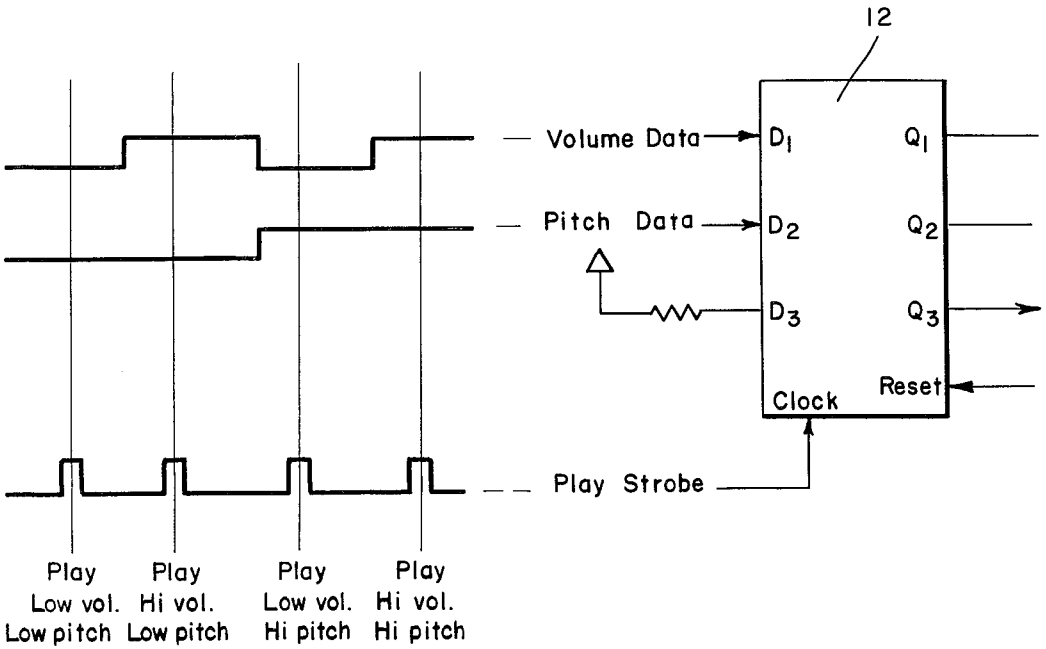
FIG. 3 is the timing diagram of the inputs from a computer which controls the rhythm patterns of the improved modular generator.

Referring now to FIG. 3 in conjunction with FIG. 2 when the improved modular drum generator 10 receives a "play" strobe pulse to the clock input of the triple bistable latch 12, with the "play" strobe pulse being equivalent to a logic "1", all data at the three data inputs or D inputs is passed to their respective data outputs or Q outputs. The first and second data outputs may either be logic "1"s or "0"s depending on the states of the first and second inputs. The third output is a logic "1" because the third input is always a logic "1". The logic "1" of the third output of the triple bistable latch 12 enables the twelve bit counter 13 to begin counting. The speed of the count is determined by the voltage controlled oscillator 21 whose output is electrically coupled to the clock input of the twelve bit counter 13 and which is controlled by both the initial pitch control, which is set by the variable voltage source 18 and the state of the second output of the triple bistable latch 12. This feature allows the pitch of the drum of the improved modular drum generator 10 to be remotely controlled by the computer. The rate of the count should be approximately two and one-half times the highest frequency desired at the audio output of the amplifier 11. The twelve bit counter 13 sequentially addresses each eight bit data word, which is stored in the read only memory 22 and which, with all $2^{12}$ words, contains a digitized recording of the desired sound of a drum strike. Each eight bit data word has $2^8$ increments of resolution. For each new count of the twelve bit counter 13 a new eight bit data word is applied to the digital to analog converter 23, in which the eight bit data word is converted to an analog voltage and then electrically transferred to the amplifier 11 through two paths: (1) through the third resistor 16 to the input of the amplifier 11; and (2) through the second resistor 15 in series with the analog switch 14, which is turned on or off by the state of the first output of the triple bistable latch 12. This feature allows the volume of the drum of the improved modular drum generator 10 to be remotely controlled by the computer. The sound emerges at the audio output of the amplifier 11.

When the twelve bit binary counter reaches its last count, (111111111111), the end of count output goes to a logic "1" thereby resetting the data outputs of the triple bistable latch 12 to logic "0"s and terminating the entire process until another "play" strobe pulse occurs. The number of bits in the count may be changed to allow for different time lengths. Additionally the number of bits in each data word may be changed to provide more or less audio resolution. Furthermore, the circuit may be redesigned to use more than one pitch or volume control bit in order to allow for more increments of remote pitch or volume control as desired.

Referring again to FIG. 1 an electronic percussion section includes a plurality of the improved modular drum generators 10, each of which is equivalent to a particular type of drum such as a block, high or low which is determined by the pitch data signal, conga, high or low which is determined by the pitch data signal, tom, which is determined by the pitch data signal, bass and snare.

From the foregoing it can be seen that an improved modular drum generator has been described. The primary advantage of the present invention is that it does not simulate the sound of a drum, but plays a recording of it. The recording is stored as a series of binary data words in a read only memory and is not merely a representative waveshape, but the entire recording of the desired drum strike. Furthermore as long as the duration of the drum is not too long the amount of read only memory that is needed may be kept to a practical level. For example, if the maximum frequency which is desired for the drum beat is ten kilohertz (10 KHz), a sampling frequency of approximately twenty-five kilohertz (25 KHz) is sufficient so that 4000 words at this frequency will take 0.16 seconds which is long enough for most drums or percussion instruments. Another advantage of the present invention is that the drums may be played at two different pitches under remote control, so that one modular drum generator may function as two different drums. Still another advantage is that the volume of the drum may be remotely controlled to stimulate a soft or hard hit of the drum.

Accordingly, it is intended that the foregoing disclosure and showing made in the drawing shall be considered only as illustrations of the present invention. Furthermore, it should be noted that the sketches are not drawn to scale and that distances of and between the figures are not to be considered significant. The invention is set forth with particularity in the appended claims.

What is claimed is:

1. An improved modular drum generator, which plays a prerecorded drum tone in response to a "play" strobe signal, comprising:

a. a bistable latch having a first data input which is electrically coupled to a logic "1", a first data output, a clock input which receives the "play" strobe signal and a reset input;

b. a voltage control oscillator having a control voltage input which is electrically coupled to a variable voltage source and an oscillating output;

c. a binary counter having an enable count which is electrically coupled to the first output of said bistable latch, an end of count which is electrically coupled to the reset input of said bistable latch, a clock input which is electrically coupled to the oscillating output of said voltage control oscillator and an output;

d. a read only memory which contains a digitized word which represents a single drum beat and which is electrically coupled to the output of said binary counter;

e. a digital to analog converter which is electrically coupled to said read only memory in order to receive the digitized word so that said digital to analog converter can reconvert the digitized word back to analog data;

f. an analog switch having a digital input which is electrically coupled to the second output of the said bistable latch, said analog switch electrically couples a first resistor to a second resistor in parallel only when said analog switch is "on"; and g. an amplifier having an input which is electrically coupled to said digital to analog converter through said first resistor when said analog switch is "off" and to said first resistor and said second resistor in parallel when said analog switch is "on" whereby the volume of the drum beat be adjusted between two levels by said analog switch.

2. An improved modular drum tone generator according to claim 1 wherein said bistable latch further has a third data input which receives a pitch data signal and a third data output and wherein said improved modular drum tone generator further comprises:

a. a third resistor which is electrically coupled to the input of said voltage control oscillator and to the third data output of said bistable latch in order to increase and decrease the voltage whereby the pitch of the drum beat may be adjusted between two frequency levels.

* * * * *